US005947314A

United States Patent [19]

Chilewich et al.

[11] Patent Number: 5,947,314

[45] Date of Patent: Sep. 7, 1999

[54] OPEN-FACED RECEPTACLE WITH REMOVABLE FABRIC RECEIVING FACE

[76] Inventors: Sandra Chilewich; Joseph Sultan, both of 1158 Fifth Ave., New York, N.Y. 10029; Julio Garciafigueroa, 121B Hastings Ave., Rutherford, N.J. 07070

[21] Appl. No.: 09/131,608

[22] Filed: Aug. 10, 1998

Related U.S. Application Data

[63] Continuation of application No. 08/824,166, Feb. 26, 1997, Pat. No. 5,829,618.

[51] Int. Cl.[6] ..... B65D 33/02

[52] U.S. Cl. ..... 220/9.4; 220/574.3; 220/495.11

[58] Field of Search ..... 220/9.4, 9.1, 9.2, 220/9.3, 495.11, 495.08, 495.06, 495.01, 574.3, 574, 668, 23.91, 666; 222/105, 183, 131; 137/585

[56] References Cited

U.S. PATENT DOCUMENTS

| | | | |
|---|---|---|---|
| 2,529,267 | 11/1950 | Sloane | 220/495.11 |
| 3,372,725 | 3/1968 | Voorhees | 220/9.2 |
| 3,396,885 | 8/1968 | Giondi | 220/9.4 |
| 4,083,392 | 4/1978 | Kobayashi | 220/495.11 |
| 5,645,353 | 7/1997 | Linnell et al. | 220/9.4 |
| 5,829,618 | 11/1998 | Clilewich et al. | 220/9.4 |

*Primary Examiner*—Stephen Castellano
*Attorney, Agent, or Firm*—Gottlieb, Rackman & Reisman, P.C.

[57] ABSTRACT

An improved open-faced receptacle with a removable fabric receiving face is provided. The receptacle comprises a frame, fabric which is selectively removable from around a portion of the frame creating a receiving face for the receptacle and a securing assembly which tautly holds a central portion of the fabric to a lower portion of the frame so that the receiving face assumes a concave shape. The frame has an upper geometrically shaped opening, which forms the upper rim of the open-faced receptacle, and a lower portion which supports the receptacle. The fabric is substantially configured to conform to the shape of this upper rim portion of the frame, with some slack in the fabric so that it can be pulled taunt by the securing assembly to create the taunt concave shape which acts as the receiving face of the receptacle. The securing assembly comprises a hook member which extends through an opening in a central portion of the fabric, a hold-down member and a bar member. The hold-down member works with the portion of the hook member above the opening in the fabric and acts to grab a small central portion of the fabric and pull it down to create the taunt concave receiving face, when the portion of the hook below the opening is secured to the bar member. The bar member is itself secured to the frame.

13 Claims, 8 Drawing Sheets

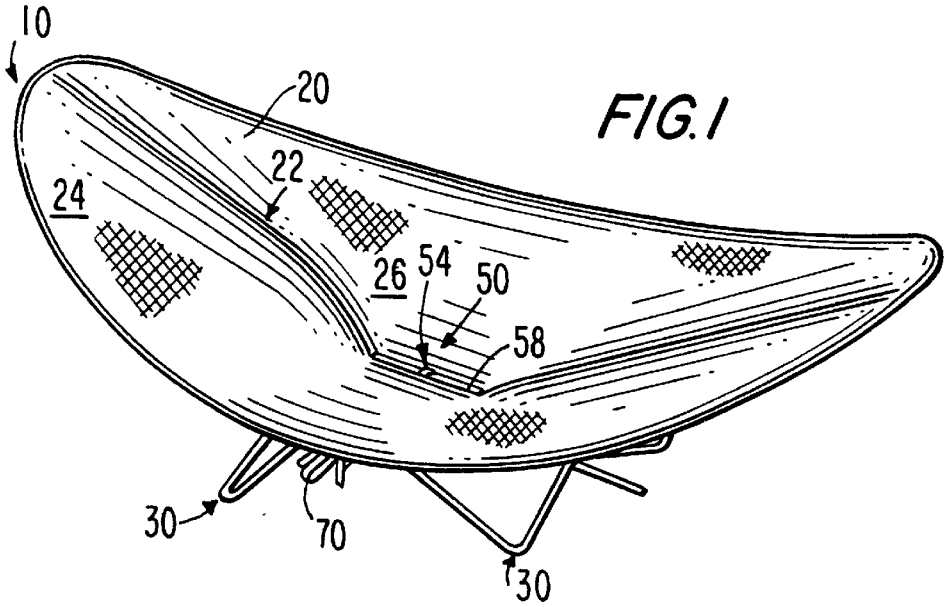
FIG. 1
FIG. 2
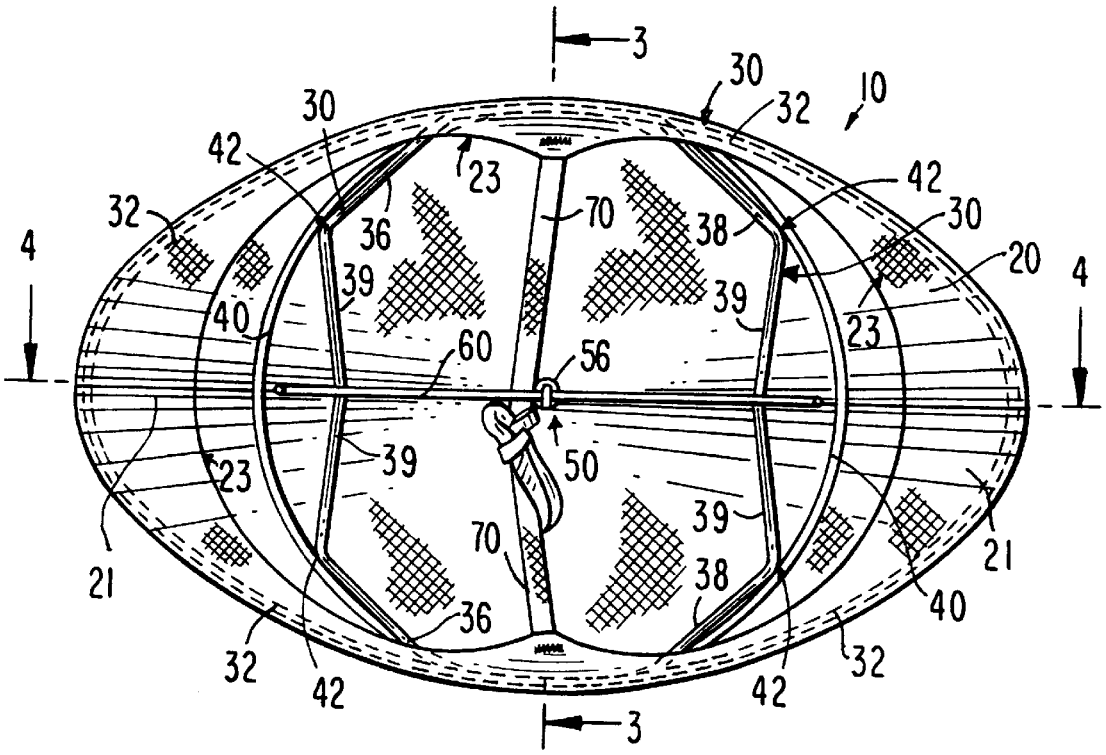

OPEN-FACED RECEPTACLE WITH REMOVABLE FABRIC RECEIVING FACE

This application is a continuation of application Ser. No. 08/824,166 filed Feb. 26, 1997, now U.S. Pat. No. 5,829, 618.

BACKGROUND OF THE INVENTION

This invention relates to the receptacle field, and more particularly, to baskets, bowls and dishes, and the like, having a removable fabric receiving structure.

Baskets, bowls and dishes are well known receptacles for holding various household objects, which are old in the art. These prior art baskets, bowls and dishes are usually made from metal (precious and non-precious), ceramics, wood and/or plastic or other rigid material. They have an upper concave receiving area for the holding of such household items as foods (candies, fruits, vegetables and snacks), and various nic-nacs such as tools, toys and papers.

Sometimes these prior art receptacles are used in association with some type of bag, so that the items being held within the receptacle are easily gathered for disposal. This basket/bag combination is normally found when speaking of garbage can receptacles.

The prior art is also composed of receptacles which are constructed of a frame assembly and an interior bag assembly. Such receptacles are normally used for garbage (as discussed above), or for items such as dirty laundry (a laundry hamper or bin) and a recyclable container. These receptacles are normally constructed so that the bag portion is somehow secured around or to the open rim of the receptacle frame. Such methods of attachment are by hooks (see U.S. Pat. No. 1,102,499 to Haist) or some type of pull-cord tieing member which is threaded around the bag's opening and can be draped over the receptacle frame rim and tied for security.

A disadvantage of this latter type of receptacle frame/bag combination is that the bag portion merely hangs within the receptacle having no shaped form. The only form attributable to these structures is given by the shape of the frame, or simply from the loose shape of a hanging sack. For example, when one thinks of the standard garbage pail and garbage bag combination, the bag has no real form other than that of a hanging sack within the confines of the framework of the garbage can. In another example, in the recycling canisters which have sprung up since the recycling craze, the frame of the recycling receptacle is usually merely a rectangular tubular structure with no side walls. In this situation, the bag portion of the combination is secured around the rim of the receptacle and merely hangs loosely down, taking many different shapes and forms as different recyclable elements are stored within.

Accordingly, it would be desirable to provide an open-faced receptacle wherein the removable fabric element does not simply hang limp within the receptacle, but creates an attractive concave receiving face which is tautly held to the frame of the receptacle. This type of receptacle would be more suited for use in the house on tables or countertops as a bowl or dish for displaying foods.

Standard bowls and dishes, as discussed above, are decorative only in the shapes they are formed into and the materials used for that forming. For example, a silver dish may have a unique shape, while a crystal dish might have both a unique shape and a unique look due to the crystal structure. Further, plastic, ceramic and even wooden dishes and bowls can have different painted colors and designs. The disadvantage of all of these types of prior art bowls and dishes are that if the owner wants to change the design or the look of the bowl or dish, he/she must totally replace the bowl or dish with another bowl or dish which, of course, may be costly.

Accordingly, it would also be desirable to provide an open-faced receptacle wherein the fabric receiving face is removable for washing or replacement by another, interchangeable receiving face.

SUMMARY OF THE INVENTION

In accordance with the invention, an improved open-faced receptacle with a removable fabric receiving face is provided. The receptacle comprises a frame, fabric which is selectively removable from around a portion of the frame creating a receiving face for the receptacle, and a securing assembly which tautly holds a central portion of the fabric to a lower portion of the frame so that the receiving face assumes a concave shape. The frame has an upper geometrically shaped opening or periphery (round, oval, rectangular, square or triangular, or any combination thereof), which shape forms the upper rim of the open-faced receptacle, and a lower portion which supports the receptacle.

The fabric is substantially configured to conform to the shape of this upper rim portion of the frame, with some slack in the fabric so that it can be pulled taunt by the securing assembly to create the taunt concave shape which acts as the receiving face of the bowl/dish. The securing assembly desirably comprises a hook member which extends through an opening in a central portion of the fabric, a hold-down member and a bar member. The hold-down member works in relation with the portion of the hook member above the opening in the fabric (on the receiving face side of the fabric), and acts to grab a portion of a central portion of the fabric and pull it down to create the taunt concave receiving face when the portion of the hook below the opening is secured to the bar member. The bar member is itself secured to the frame.

Accordingly it is an object of the invention to provide an improved open-faced receptacle.

Another object of the invention is to provide an open-faced receptacle with a removable fabric receiving face.

Yet another object of the invention is to provide an open-faced receptacle wherein the removable fabric receiving face is selectively tautly held in a concave shape for the receipt of decorative and food items.

Still another object of the invention is to provide an open-faced receptacle wherein the fabric receiving face is easily removable for washing or interchangeable with another fabric receiving face through use of an easily manipulated securing assembly.

Other objects of the invention will in part be obvious and will in part be apparent from the following description.

The invention accordingly comprises assemblies possessing the features, properties and relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 1 is a perspective view of an open-faced receptacle made in accordance with the invention;

FIG. 2 is a bottom plan view of the receptacle of FIG. 1, showing a removable bar member;

DETAILED DESCRIPTION OF THE PREFERRED EMBODIMENTS

Referring to FIGS. 1–5, a first embodiment of the inventive open-faced receptacle made in accordance with the invention and generally designated as 10, is shown. Receptacle 10 includes fabric 20, frame 30 and securing assembly 50.

Figure 3:
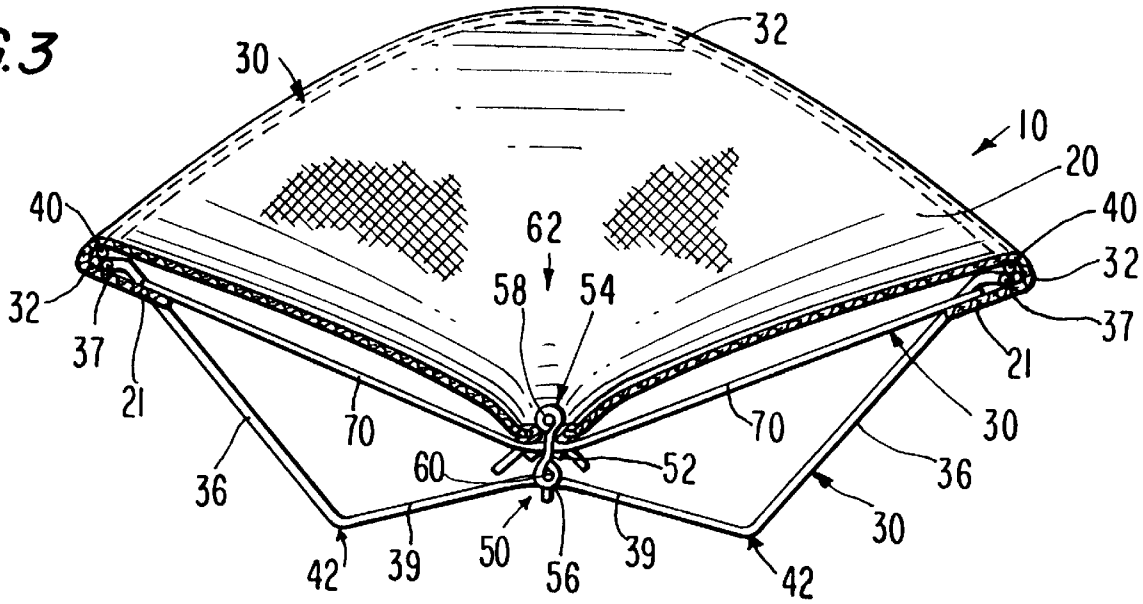
FIG. 3 is a cross-sectional view taken along line 3—3 of FIG. 2.
Figure 4:
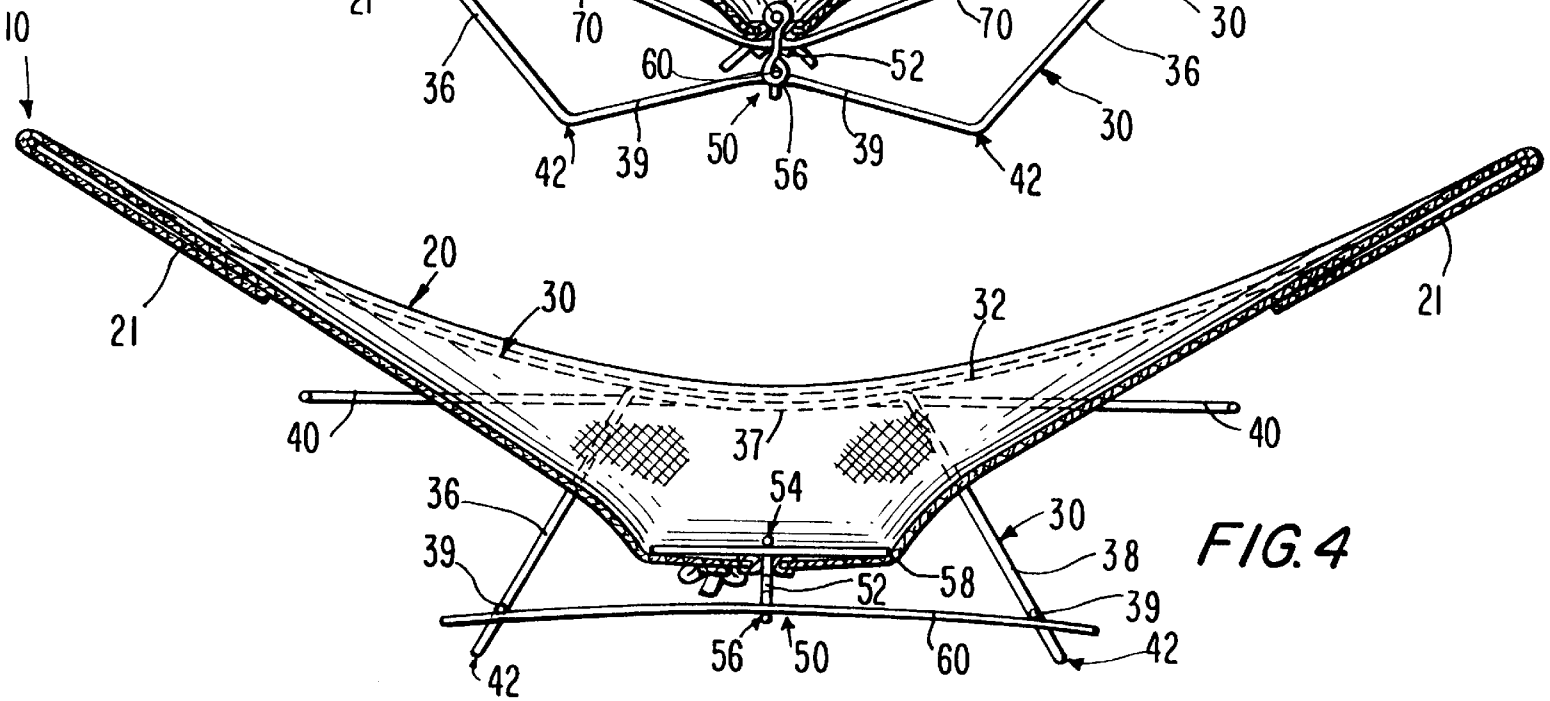
FIG. 4 is a cross-sectional view taken along line 4—4 of FIG. 2.
Figure 5:
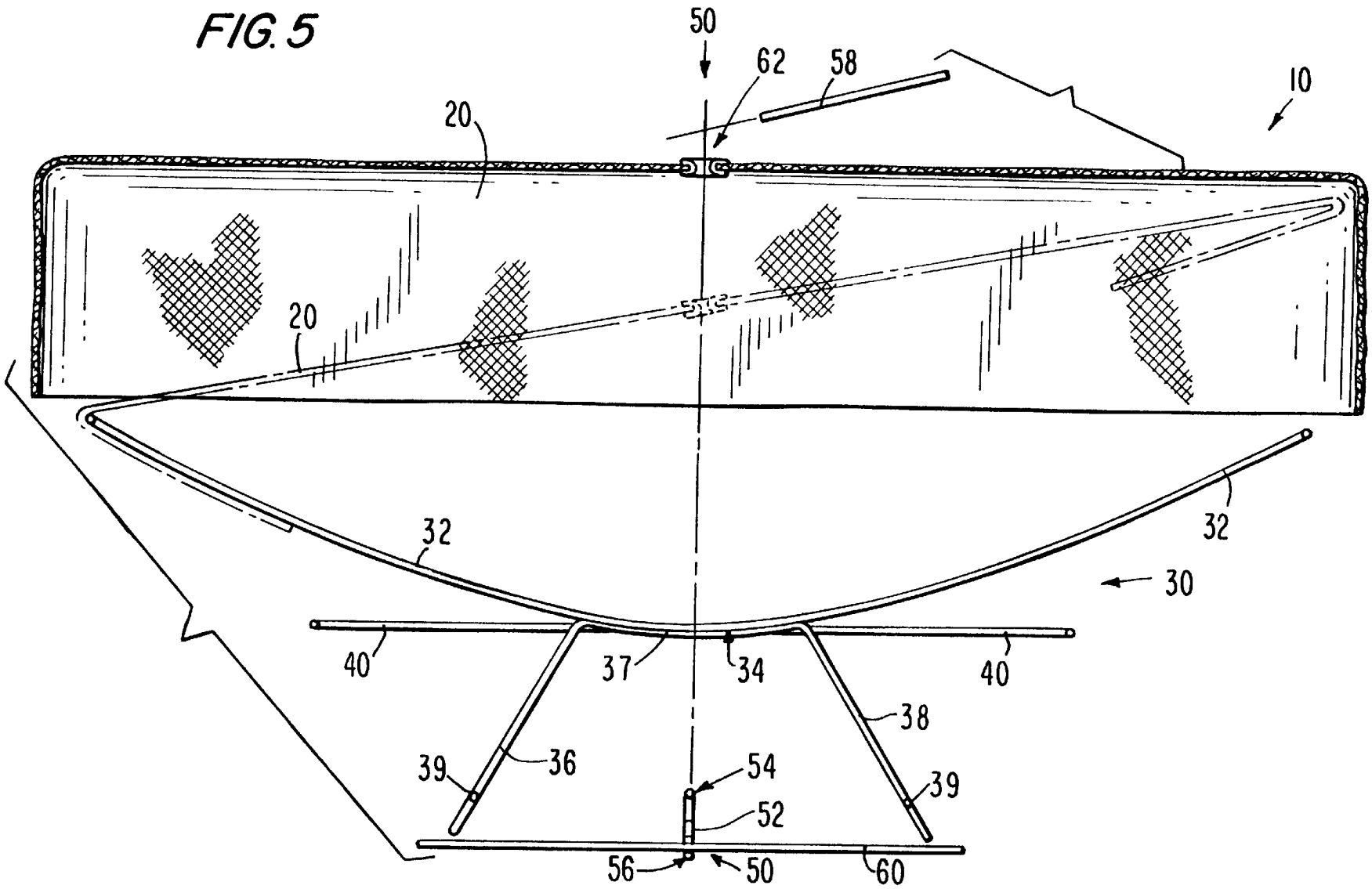
FIG. 5 is an exploded cross-sectional elevational view of the receptacle of FIG. 1, showing how the fabric is removable from the frame of the receptacle.

Frame 30, as best seen in FIGS. 2, 3 and 5, has frame members 32, 34 and 40. Frame member 32 is the upper rim of the open-faced receptacle 10, around which fabric 20 is removably secured (see FIGS. 2–4). Frame member 34 is the support portion of frame 30, supporting the entire bowl surface which is created by the combination of frame member 32 and fabric 20. Frame member 34 consists of members 36, 37, 38, 39 and 42. As seen in FIGS. 2–5, frame member 34 extends from frame member 32 (at member 37, see FIGS. 3 and 4), downward as leg members 36 and 38 to support surface contact points 42 (see FIGS. 2 and 3). Leg members 36 and 38 are connected by members 39.

Frame 30 is preferably constructed of metal wire, but it is anticipated by the invention that any material can be used to form frame 30. Examples of different materials could be ceramics, glass, wood or plastics.

Regarding frame member 40, as best seen in FIGS. 2 and 4, member 40 is a substantially horizontally placed, substantially circular frame element which lends fabric 20, in its taunt position, extra support. Member 40 creates a situation where fabric 20 is closer to a horizontal plane in the upper portions than it is closer to a more sloped plane near securing assembly 50. This is best seen in FIG. 1 where in and around 22, fabric 20 is supported on member 40, with area 24 of fabric 20 having the more horizontal orientation, and area 26 of fabric 20 having the steeper, more vertical orientation. Obviously, the exact shape of the fabric will be determined by the exact shape of the frame, and variations of such shapes are all within the scope of the present invention.

Fabric 20 can be of any flexible or non-flexible natural or man-made fabric. It is able to have different designs printed or otherwise formed on it. Fabric here is meant to include virtually any thin flexible material, usable for the purposes herein described.

Fabric 20 is constructed in such a way that it fits securely over frame member 32, with an overlapping flap area 21 fitting about member 32. In the embodiment shown in FIGS. 1–5, fabric 20 does not have an elastic element within flap 21, and instead is securely held around member 32 through means of securing strap 70. As seen in FIG. 2, securing strap 70 is tied on the bottom on receptacle 10 creating tension of fabric 20 around member 32.

Figure 9:
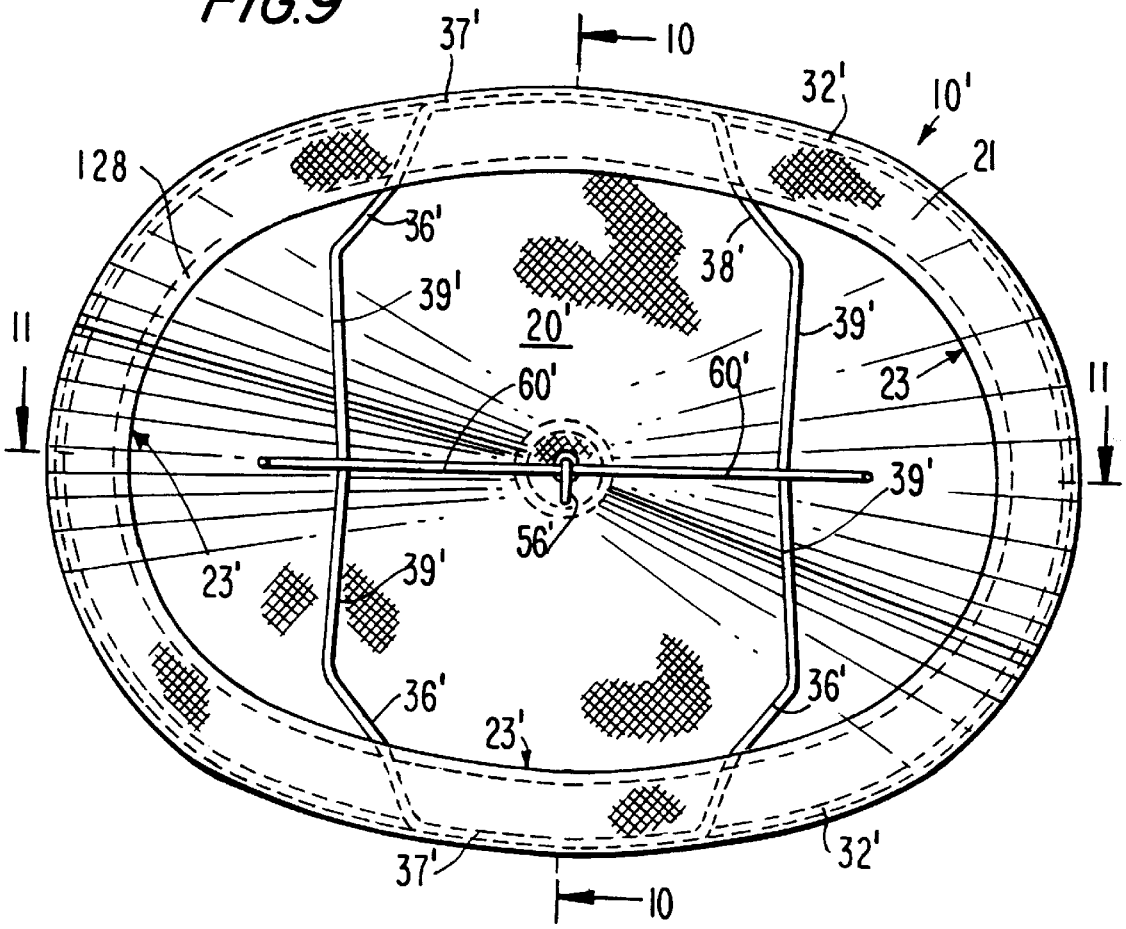
FIG. 9 is a bottom plan view of the receptacle of FIG. 8, showing a removable bar member.
Figure 10:
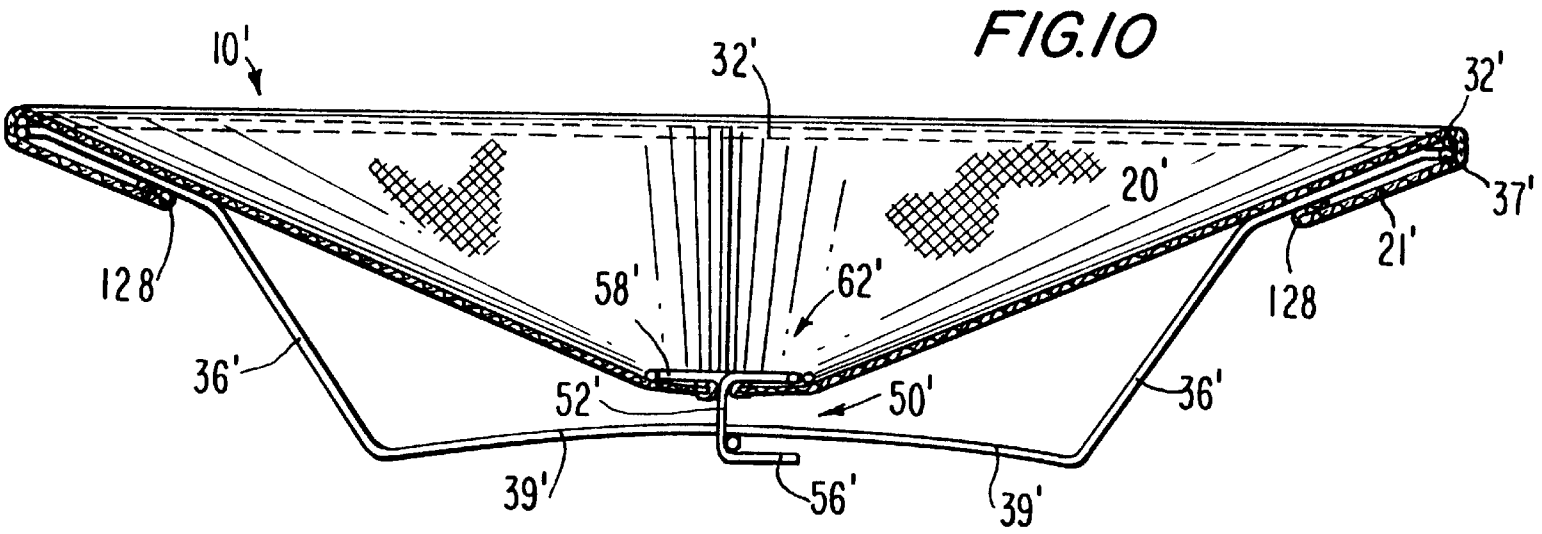
FIG. 10 is a cross-sectional view taken along line 10—10 of FIG. 9.
Figure 11:
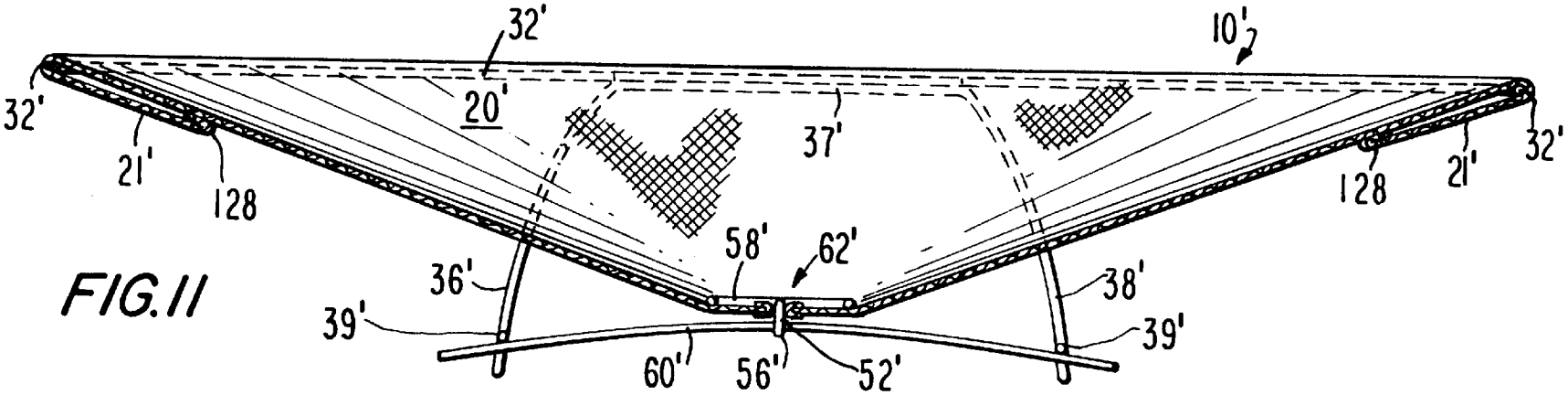
FIG. 11 is a cross-sectional view taken along line 11—11 of FIG. 9.
Figure 12:
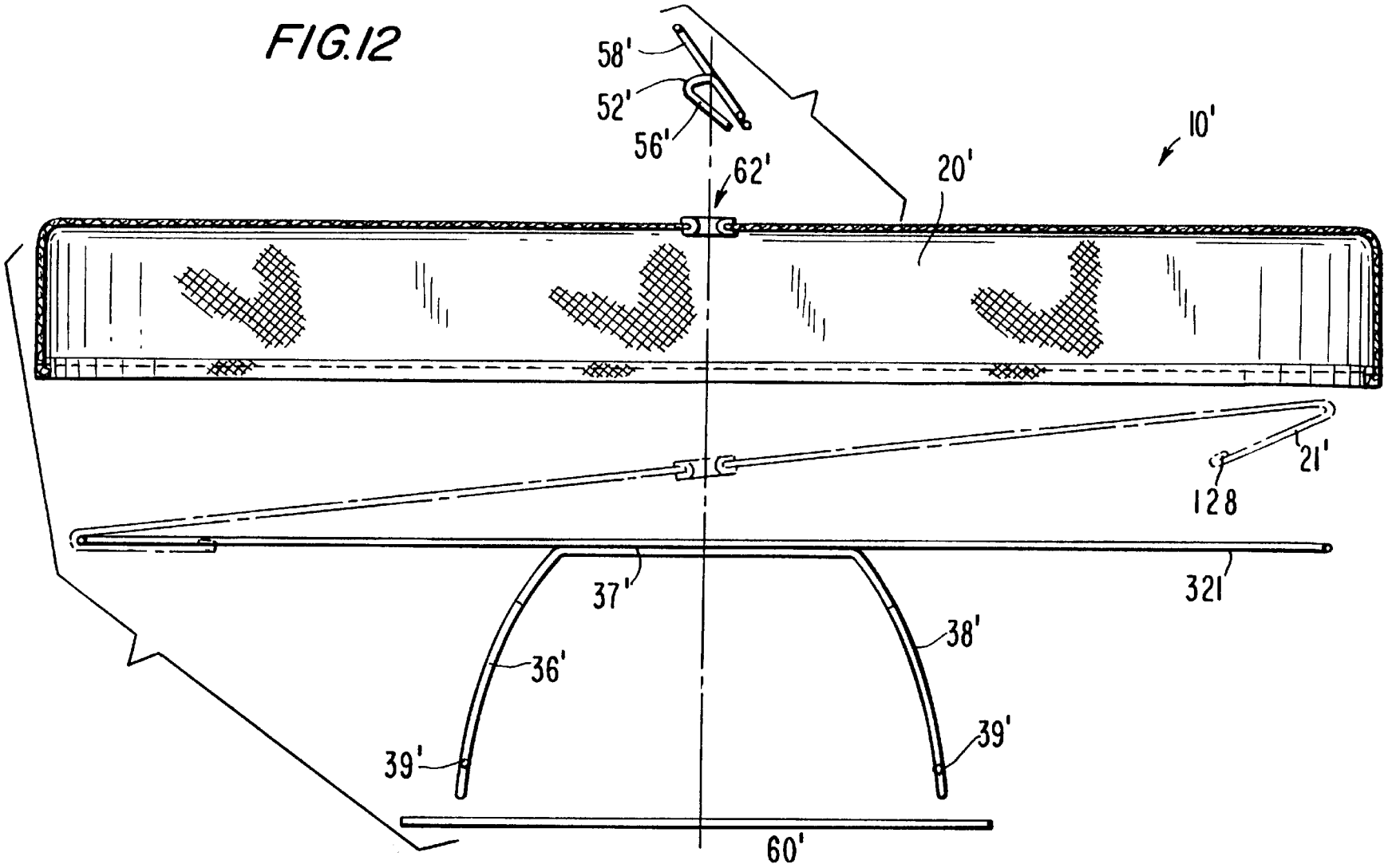
FIG. 12 is an exploded cross-sectional elevational view of the receptacle of FIG. 1, showing how the fabric is removable from the frame of the receptacle.

As will be discussed later in connection with the second embodiment of the invention, fabric 20 can also have an elastic element (element 128 of FIG. 9) which creates the security of fabric 20 over member 32, without the need of securing strap 70.

Fabric 20 is desirably washable, and one of the advantages of the invention is that a person using the inventive device as a fruit bowl, for example, which can get dirty from spoiled fruit or dirty hands, can easily remove and clean fabric 20 by following standard washing instructions. Fabric 20 can also be replaced with other fabrics 20, having different designs or colors, so that the same bowl or dish can be used over and over again on different holidays, showing different themes in fabric 20's design.

An additional element of fabric 20 can be an extension of fabric 20 (not shown) around its edge 23. The extra fabric is used for covering items in receptacle 10. Said items can include, but are not limited to, hot bread, for which the extra fabric helps keep warm.

Regarding securing assembly 50, it comprises hook element 52, having upper portion 54 and lower portion 56, hold-down member 58 and bar member 60. In practice, securing assembly 50 operates when hold-down member 58 is secured through upper portion 54 of hook 52, hook 52 extends through opening 62 of fabric 20 (see FIG. 5), and lower portion 54 of hook 52 receives bar member 60 therethrough and bar member 60 is restrained in position against frame members 39 (see FIGS. 1–4).

As seen in FIG. 5, fabric 20 is easily removable from frame 30 by removing bar 60 from engagement with lower portion 56 of hook 52, and allowing hook 52 to exit upward through opening 62 of fabric 20 so as to allow for release of hold-down member 58.

Figure 6:
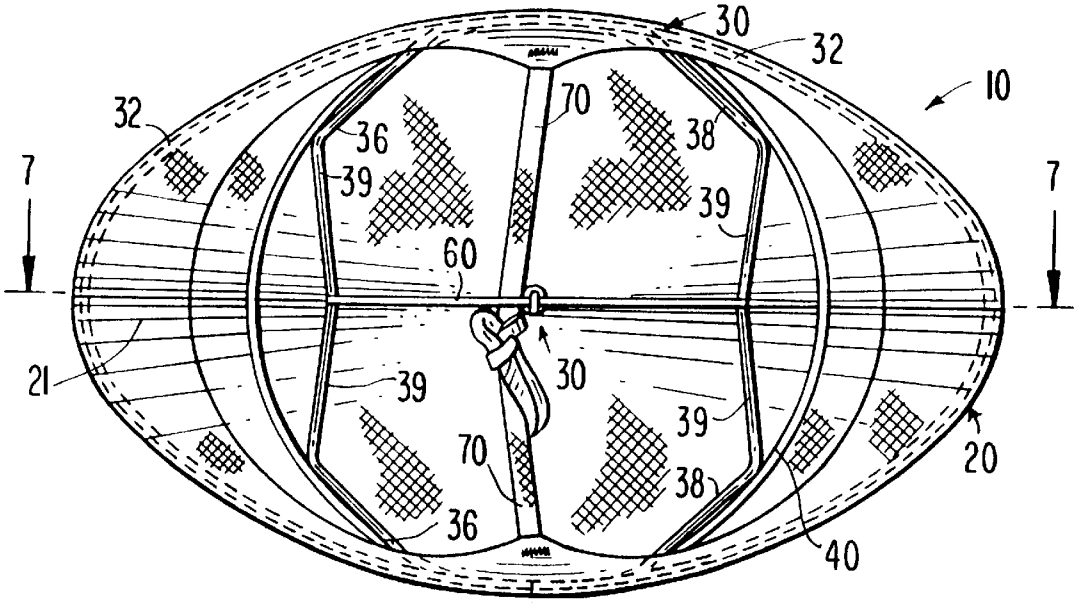
FIG. 6 is a bottom plan view of an alternate embodiment of the receptacle of FIG. 1, showing a welded-on bar member.
Figure 7:
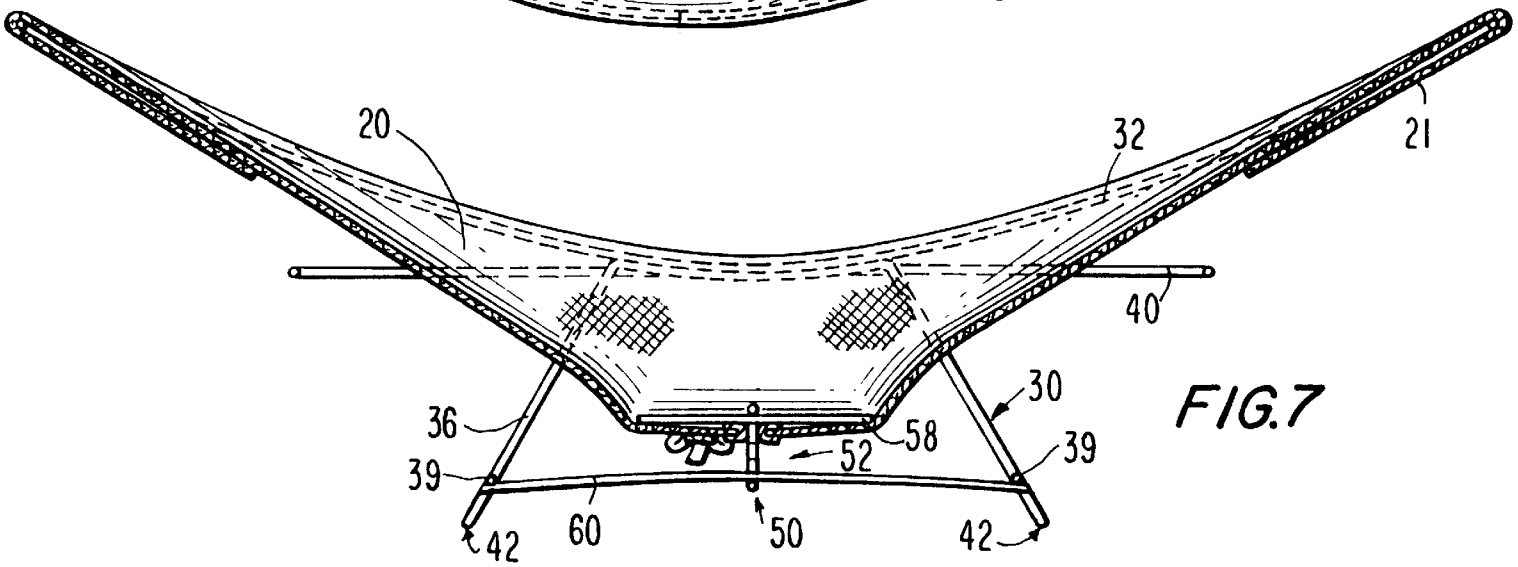
FIG. 7 is a cross-sectional view taken along line 7—7 of FIG. 6.
Figure 8:
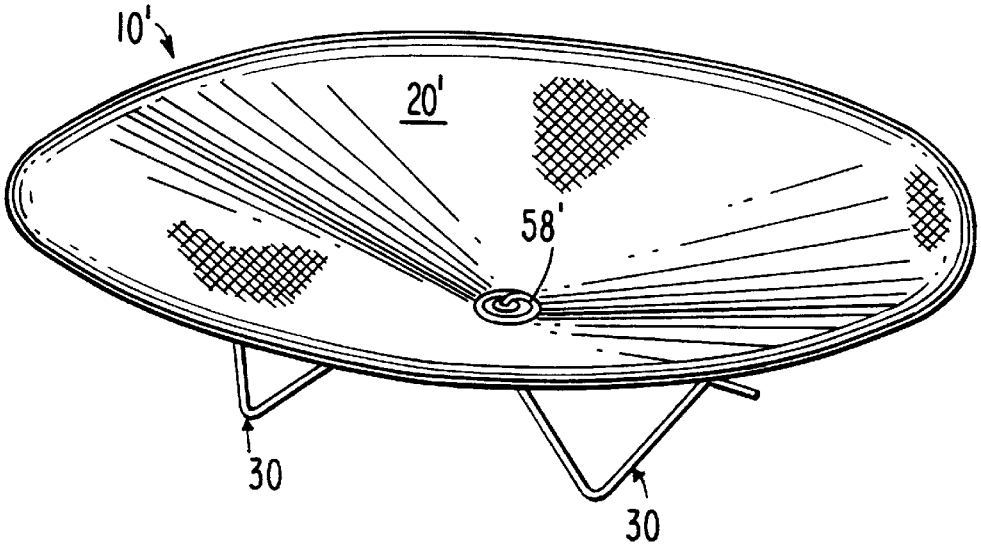
FIG. 8 is a perspective view of a second embodiment of an open-faced receptacle made in accordance with the invention.

Directing attention now to the alternate embodiment of the embodiment of FIGS. 1–5, as is shown in FIGS. 6 and 7, the only difference in this alternate embodiment is that bar 60 is no longer removable from frame 30, but is instead welded or otherwise secured to the members 39. In this embodiment, the user of receptacle 10 would need to push down on the center portion of fabric 20 where opening 62 is located so as to loosen hold-down member 58 for removal from upper portion 54 of hook 52. With hold-down member 58 removed, hook 52 will be removed from opening 62, and fabric 20 can be removed from frame 30.

Directing attention now to the second embodiment of the invention, as shown in FIGS. 8–12, the essential structure and function of the invention is the same as has been described for the embodiment of FIGS. 1–7. However, embodiment 2 shows elastic 128 in flap 21' of fabric 20' (see FIG. 9). Another distinction is frame 30' of FIGS. 8–12 does not require frame member 40.

Finally, securing assembly 50', while identical in purpose to securing assembly 50, is constructed differently. In this embodiment, securing assembly 50' consists of two independent pieces, not three independent pieces. More particularly, in this embodiment, hook 52' has a lower portion 56', but no upper portion 54'. Instead, hold-down member 58' acts as both the upper portion of hook 52' and the hold-down member. This creates a uniform or combined hook 52' and hold-down member 58'.

In operation, securing assembly 50' operates by inserting hook 52' through opening 62' in fabric 20' so that lower portion 54' engages bar 60'. In this position, hold-down member 58' engages a small central portion of fabric 20' to hold fabric 20' in its taunt concave shape, while member 60' is positioned against frame members 39'.

As with embodiment 1, bar 60' can be disengaged from connection with members 39' so as to release hook 52' for removal through opening 62', and removal of fabric 20' from frame 30'.

Figure 13:
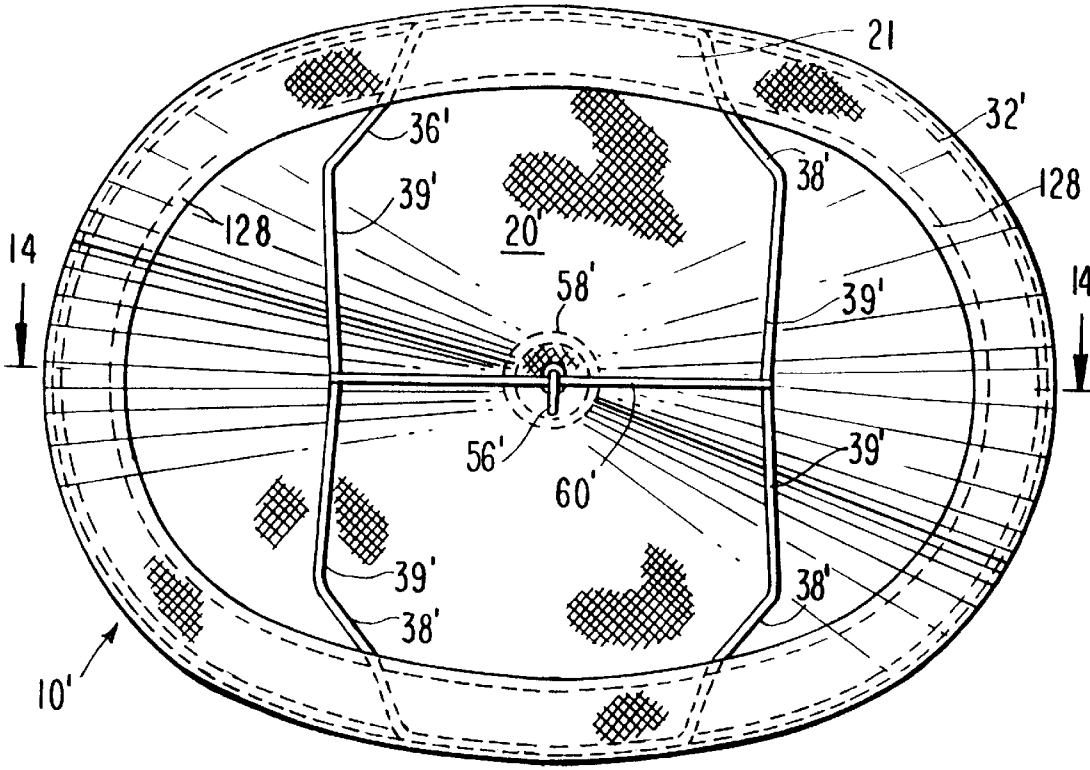
FIG. 13 is a bottom plan view of an alternate embodiment of the receptacle of FIG. 8, showing a welded-on bar member.
Figure 14:
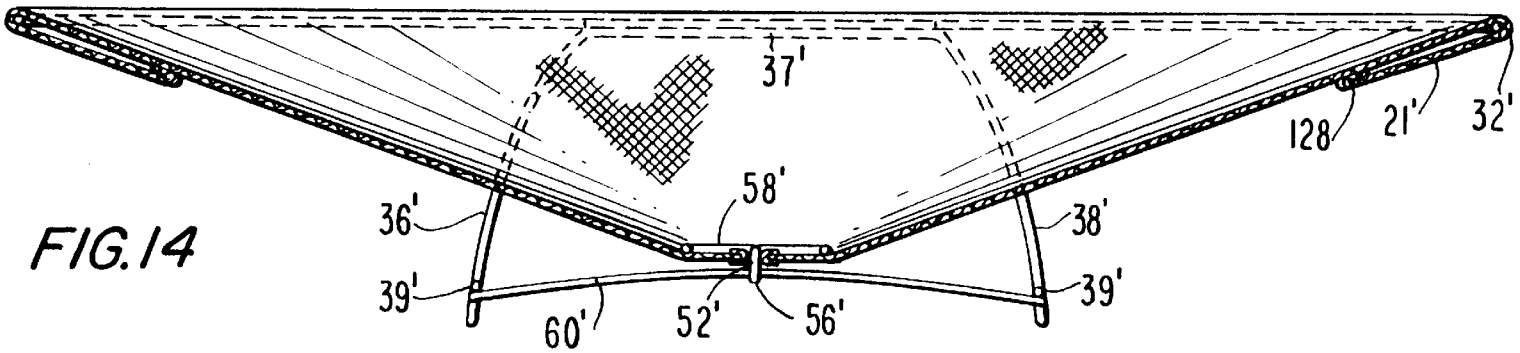
FIG.14 is a cross-sectional view taken along line 14—14 of FIG. 13.

In an alternate embodiment to that shown in FIGS. 8–12, bar 60' can be welded or otherwise secured to frame members 39' (see FIGS. 13 and 14). As with the first embodiment of the invention, if bar 60' is welded to frame members 39', to disengage hook 52', the user must press down on the central portion of fabric 20'. This allows for lower portion 56' to unhook from its engagement with bar 60', thereby allowing for removal of hook 52' through opening 62', and for removal of fabric 20' from frame 30'.

It will thus be seen that the objects set forth above, among those made apparent from the preceding description, are efficiently attained, and, since certain changes may be made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which, as a matter of language might be said to fall therebetween.

We claim:

1. An open-faced receptacle adapted to receive relatively small objects, comprising:

a frame with an upper rim;

a stretchable fabric member removably secured around the rim of said frame and having a first configuration in which said fabric member is essentially flat and taut and spans said rim; and a securing member removably connecting and pulling a substantially central portion of said fabric member toward a lower portion of the frame to define a second configuration for said fabric member;

the fabric in said second configuration forming an open receiving face having a taut continuously curved concave shape.

2. The receptacle of claim 1, wherein said securing member comprising a hook member extending through an opening in the fabric.

3. The receptacle of claim 2, wherein said fabric has a receiving face and said hook member has an upper portion above said opening in working relation with said receiving face of said fabric.

4. The receptacle of claim 2, wherein said securing member further includes a hold-down member in working relation with said upper portion of said hook member for holding said substantially central portion of said fabric in said taut continuously curved concave shape when said fabric is secured around said rim and pulled toward said lower portion of said frame.

5. The receptacle of claim 1, wherein said fabric has a first securing strap extending from a first edge section of fabric and a second securing strap extending from a second edge section of the fabric, wherein said second edge section is opposite said first edge section.

6. The receptacle of claim 1, wherein said fabric is selectively removably secured around the rim of said frame through the use of an elastic element on a portion of said fabric.

7. An open-faced receptacle adapted to receive relatively small objects, comprising:

a frame with an upper rim;

a fabric member removably secured around said frame;

a securing member for removably connecting and pulling a substantially central portion of said fabric member toward a lower portion of said frame;

the fabric when secured around said rim and when pulled toward said lower portion of the frame forming an open receiving face having a taut continuously curved concave shape;

said fabric being stretchable between an essentially flat position spanning said rim and a position defining said taut continuously curved concave shape.

8. The receptacle of claim 7, wherein said securing member comprising a hook member extending through an opening in the fabric.

9. The receptacle of claim 8, wherein said fabric has a receiving face and said hook member has an upper portion above said opening in working relation with said receiving face of said fabric.

10. The receptacle of claim 7, wherein said securing member further includes a hold-down member in working relation with said upper portion of said hook member for holding said substantially central portion of said fabric in said taut continuously curved concave shape when said fabric is secured around said rim and pulled toward said lower portion of said frame.

11. The receptacle of claim 7, wherein said fabric has a first securing strap extending from a first edge section of fabric and a second securing strap extending from a second edge section of the fabric, wherein said second edge section is opposite said first edge section.

12. The receptacle of claim 7, wherein said fabric is selectively removably secured around the rim of said frame through the use of an elastic element on a portion of said fabric.

13. An open-faced receptacle comprising:

a frame including an upper rim and a stand;

a stretchable fabric member having an outer edge engaged to the rim, said fabric member having a first configuration in which said fabric member is substantially flat and spans said rim;

a securing member connected between a central portion of the fabric member and said stand, said securing member pulling the fabric member tautly toward the stand in a second configuration of said fabric member, the tension on the fabric member between the rim and the stand causing said fabric to define a concave face in said second configuration.

* * * * *